US006394081B1

(12) United States Patent
Aguirre-Esponda et al.

(10) Patent No.: US 6,394,081 B1
(45) Date of Patent: May 28, 2002

(54) SAFETY KNOB FOR DOMESTIC GAS APPARATUSES

(75) Inventors: Guillermo-José Aguirre-Esponda; José-Angel Avalos-Barcenas, both of San Luis Potosi (MX)

(73) Assignee: Comercial Acros Whirlpool, S.A. DE C.V., Nuevo Leon (MX)

( * ) Notice: Subject to any disclaimer, the term of this patent is extended or adjusted under 35 U.S.C. 154(b) by 0 days.

(21) Appl. No.: 09/595,407

(22) Filed: Jun. 16, 2000

(30) Foreign Application Priority Data

Jun. 18, 1999 (MX) ..... 995701

(51) Int. Cl.[7] ..... F24C 3/12
(52) U.S. Cl. ..... 126/42; 251/96; 70/175
(58) Field of Search ..... 126/42; 431/153; 251/96, 101; 70/175, 176, 179

(56) References Cited

U.S. PATENT DOCUMENTS 2,797,591 A * 7/1957 Marrapese ..... 126/42
2,849,891 A * 9/1958 Mills ..... 126/42
4,300,525 A 11/1981 Delgado et al.
4,527,540 A 7/1985 Ryan et al. ..... 126/42
5,771,878 A * 6/1998 Lewis et al. ..... 126/42

* cited by examiner

*Primary Examiner*—Sara Clarke
(74) *Attorney, Agent, or Firm*—Abelman, Frayne & Schwab

(57) ABSTRACT

The present invention is referred to a safety knob for domestic gas apparatuses of the type that includes a gas valve with a stem, and wherein the stem is pushed against the body of the gas valve to open and regulate the gas flow. The improvements comprising a knob having a body with a back flat section and one or more cavities or projections formed on the back flat section of the knob and a longitudinal orifice also in its back part, which is connected in coincidence with a free end of the stem of the gas valve. The knob includes safety elements for avoiding the axial movement of the knob, the safety elements having a series of projections, wherein the cavities of the knob and the projections of the safety elements are joined or separated one from another, for placing the stem of said valve in a unblocked or blocked position.

3 Claims, 2 Drawing Sheets

FIG. 1
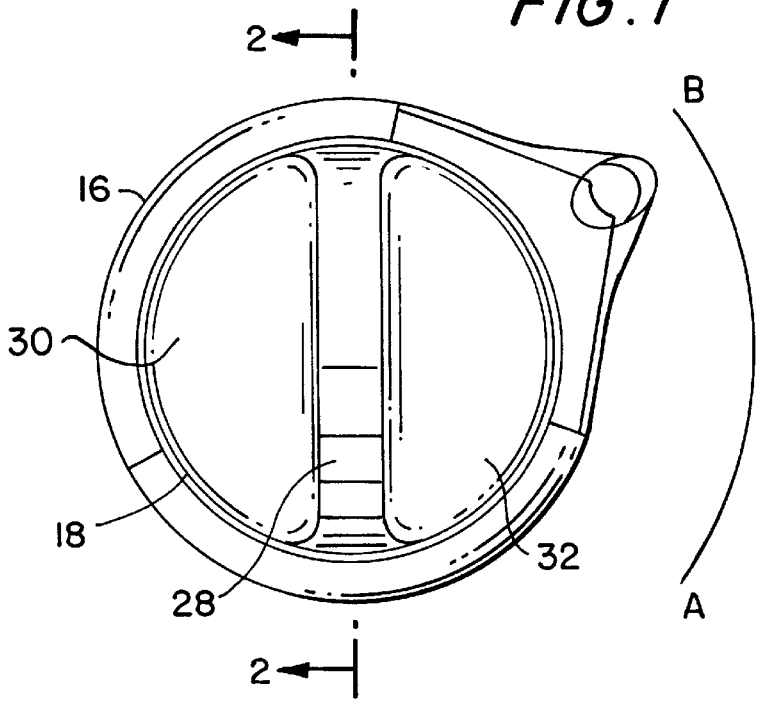
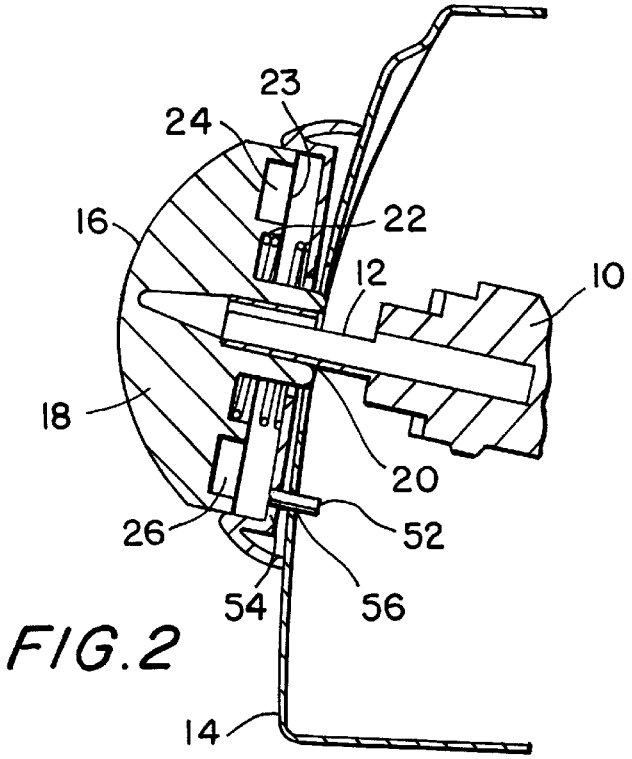
FIG. 2

SAFETY KNOB FOR DOMESTIC GAS APPARATUSES

FIELD OF THE INVENTION present invention refers to knobs for gas valves, and more particularly, to a safety knob for domestic use gas apparatuses, which prevents the user from inadvertently opening the gas tap and prevents that it be operated by children.

BACKGROUND OF THE INVENTION

There are already available in the market domestic gas valves, which have a mechanism of coupling-uncoupling between a stem of the valve and a closing element. The latter can have the shape of a cone, a cylinder or a disc. In order to be able to operate the gas valve, it is necessary that the user push a knob to couple the stem for the opening and closing the elements of the valve. During this operation, the force of pushing on the knob must be sustained, and the knob simultaneously turned. (normally towards the left) so that the valve will open, thus permitting the regular flow of gas towards the burner.

However, one of the two problems of the assembly of the knobbed-gas valves is that they accidentally sometimes are operated by the user or mainly by children, thus causing the gas to escape through the burners and putting the home or building safety of the user where the apparatus is installed at risk.

There are already some safety devices available in the market for blocking children's access to range knobs, for example, the U.S. Pat. No. 4300525 issued to Jesus Delgado and George Spector describes a safe knob assembly for a kitchen gas stove burner, comprising in combination, a knob integral with shank having a square central opening slidably fitted on a square end of a stem of a gas valve along a gas line of a stove, a cam-faced spur on a side of said shank, and a stationary stop mounted separately adjacent said spur in combination with means for axially moving said shank in response to rotation in one direction of said shank and wherein rotation in opposite direction is restricted by engagement of said spur and stop. However, the operation of the knob can be operated by children.

Another form of protecting gas range knobs from children is illustrated in the U.S. Pat. No. 4,527,540 issued to Kathryn A. Ryan, which describes a safety shield for isolating a heated appliance, such as a stove or an oven, from the reach of children includes a flexible sheet of material having securing portions along opposite vertical edges for securing the sheet adjacent the sides of the front face of the appliance and an arched shielding portion extending horizontally between the securing portions and spanning the front face of the appliance, the arched shielding portion being bowed outwardly away from the front face of the appliance to shield the appliance from the reach of children. However, the safety shield needs to be removed by the user in order to gain access to the gas knobs.

There are other designs such as guards that only cover the knobs, which are manufactured out of transparent, temperature resistant material.

In accordance with the above, the present invention refers to a safety knob for domestic gas apparatuses, which prevents or deters children from operating the valve.

OBJECTIVES OF THE INVENTION

It is therefore a first objective of the present invention to provide a safety knob for domestic gas apparatuses, which is difficult for children to operate.

It is another objective of the present invention to provide a safety knob for domestic gas apparatuses, which does not need additional elements to cover the ranges that alter their appearance or functionality.

An additional objective of the present invention is to provide a safety knob for domestic gas apparatuses, which can be used with any type of conventional safety valves.

These and other objectives and advantages of the present invention will be evident to the experts in the field from the following detailed description of the invention, which is illustrated in the attached drawings.

BRIEF DESCRIPTION OF THE DRAWINGS

FIG. 1 shows a front view of the first embodiment of the safety knob for domestic gas apparatuses, in accordance with the present invention;

FIG. 2 shows a laterally cut view, taken of FIG. 1, of the safety knob of the present invention;

DETAILED DESCRIPTION OF THE INVENTION

Figure 3:
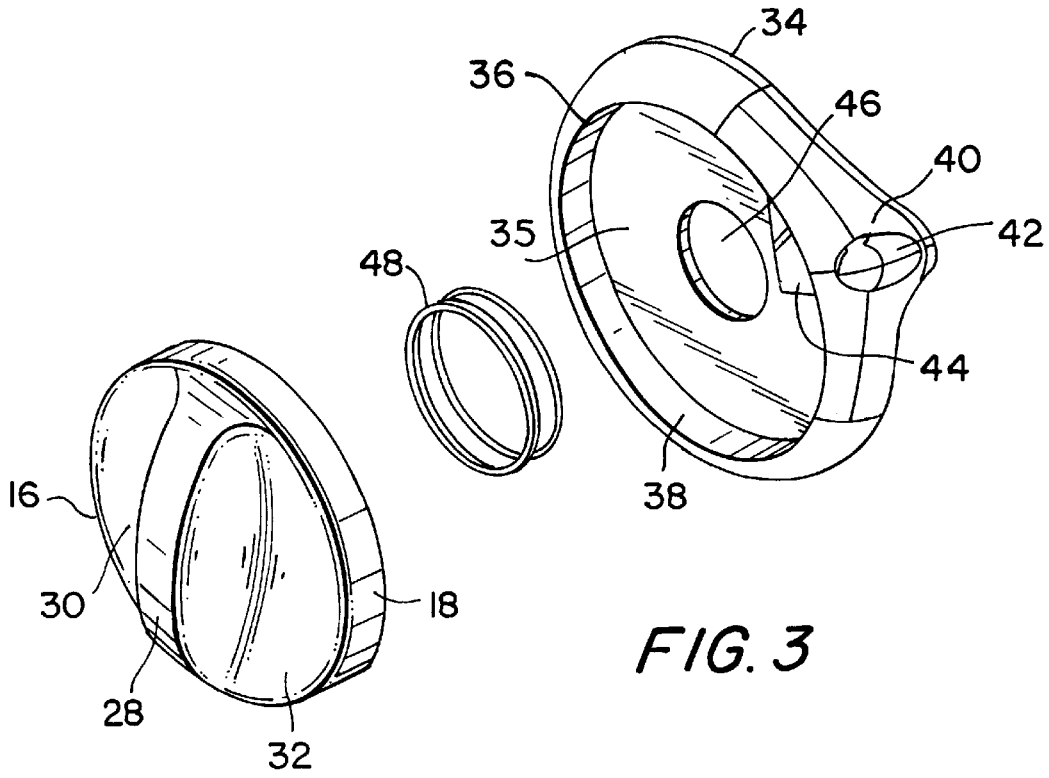
FIG. 3 shows an exploded view of the safety knob assembly of the present invention; and, FIG. 4 shows a cut view of a second embodiment of the present invention.

Now, making particular reference to FIGS. 1 and 3, a first embodiment of the present invention is shown, wherein is illustrated in a schematic form the body of a gas valve 10, which has a stem 12, which is pushed against the body of said valve 10, and simultaneously it is made to rotate the valve 10.

In the FIG. 2 is showed an assembly of the valve 10 and the stem 12, located at the front of a board 14 or in front of knobs of a range (not shown).

A knob 16 comprising a first body of the knob 18, which has a concentric orifice 20, in the body of the knob 18. Said orifice 20, is located in the back part of the body of the knob 18. A circular recess 22 is located in the back part of,the body of the knob 18, which surrounds the concentric orifice 20. The back part of the body of the knob 18 comprises a flat area 23, which includes a series of coupling cavities 24, 26, which are distributed around the circular recess 22.

The frontal part of the knob 18, has a projection 28, that has the form of a bar that divides the body of the knob 18, into two recesses 30, 32, to facilitate taking hold of it with the fingers.

A circular disc 34 having a top flat face 35 and a circumferential border 36, said circumferential border 36 projects upwardly from the top flat surface 35, forming a cylindrical cavity 38, wherein is stored the body of the knob 18, to guide the turning movement of the body of the knob 18, over the circular disc 34. The disc 34 includes a projection 40, in its external periphery, in order to move the disc 34, with the fingers, into operation and blocking positions of the gas valve 10. The projection 40 includes an indicator 42, to indicate the position of the disc 34.

A series of coupling projections 44, in the form of a cam, formed over the top flat face 35, of the disc 34. The coupling projections 44, work in cooperation with the coupling cavities 24, 26, formed in the flat area 23, of the back part of the body of the knob 18. Finally, the disc 34 includes a central orifice 46, over the flat face 35.

As can be clearly seen in FIG. 3, the body of the knob 18 is coupled over the disc 34. A spring 48 is coupled between the circular recess 22 of the back part of the knob 18, and the flat face 35 of the disc 34. The spring 48 has as its object to maintain the back face of the disc 34, in contact with the board or front of the knobs 14, in such a manner that said spring 48, be fixed by friction in the position selected by the user.

In accordance with the embodiment illustrated in FIGS. 1 and 3, the functioning of the safety knob of the present invention is carried out in the following manner: when the user wishes to open the assembly of the gas valve 10, he first has to move disc 34 in a semi circular movement from a blocked position A (valve 10 does not operate) into an unblocked position B (operating position). It is important to comment that during the blocked position of valve 10, the coupling projections 44, formed over the top flat face 35, of the disc 34, and the coupling cavity 24 or 26, (it can be one or the other) which are formed on the flat area 23, of the body of the knob 18, are not coincidental to each other. Therefore, the edge of the projections 44, separate the body of the knob 18, from the top flat face 35 of the disc 34, restricting the axial movement of the knob 16, preventing that the stem 12, of the gas valve, be pushed.

In the unblocked position B (position for operation), the coupling projections 44, and the coupling cavity 24 or 26 (it can be one or the other), are coincident to each other, permitting the axial pushing movement of the stem of the knob 12, which permits the stated valve 10, to be opened by the user. Once the knob 16, is taken to its closing position, if the user wishes to insure the safety valve 10, he will have to reposition the disc 34, to the blocked position, A.

Figure 4:
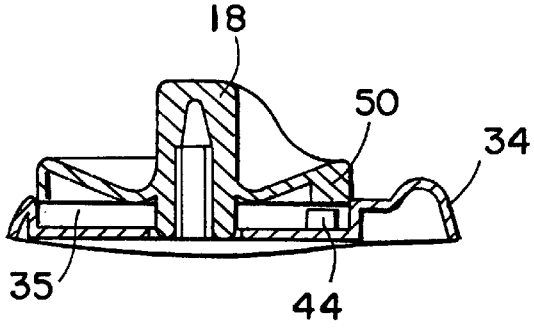

Now making particular reference to FIG. 4, it shows the body of the knob 18, including borders or projections 50, distributed in the back part of the body of the knob 18.

In keeping with the illustrated embodiment in FIG. 4, the functioning of the safety knob of the present invention is carried out in the following manner: when the user wishes to open the assembly of the gas valve, 10, first he has to move, with a semi circular movement of the disc, 34, from a blocked position A (valve 10 does not operate) to an operating position B. In this case, the blocked position of valve 10 is carried out through the alignment of the coupling projections 44, formed over the upper flat face 35, of the disc 34, with the edges of coupling or projections 50, of the back part of the body of the knob 18, thus restricting the axial movement 16, preventing that the stem 12, of the gas valve 10, be pushed.

In the unblocked position B, (operating position), the coupling projections 44, and the coupling edges 50, are phased out at an angle, by the movement of disc 34, permitting the movement of the axial pushing of the knob 16 to the stem 12, which enables said valve 10, to be opened by the user. Once that the. knob 16, is placed in its closed position, if the user wishes to insure that valve 10, cannot be opened, he will have to reposition the disc 34 to the blocked position A.

Disc 36 includes, in addition, a bolt 52, that is perpendicular to its back face 54, which limits the turning movement of the disc 34, from the blocked position A, to the unblocked position B. Said bolt 52, is inserted into a groove 56, that has the form of a circumferential segment, which is cut at the board or at the front part of the knob 14.

Even when two embodiments of the present invention have been described, it must be finally understood that the knob of the present invention, which has been described above, are only embodiments of the same and that the experts in the field will be able, through the teaching of the present invention, to make changes in its design and distribution. However, they will be included in the true spirit and scope of the invention that is claimed in the following claims.

We claim:

1. A safety knob for a domestic gas apparatus which comprises: a body of a gas valve; a stem integral with said gas valve, said stem being pressed against the body of said gas valve for pressing and simultaneously rotating the stem in the body of the gas valve to open and regulate the flow of gas through said valve;

said knob having a body with a first back flat section;

at least a first coupling element positioned over the first back flat section;

a longitudinal orifice formed in a rear section of said knob, said longitudinal orifice being connected with the stem of the gas valve; and safety means for avoiding the axial movement of the knob, said safety means including a flat surface disc; a border which projects upwardly from the flat surface to form a cylindrical cavity; and, at least a second coupling element on an upper part of the flat surface disc, whereby said first coupling element of the knob and said second coupling element on the flat surface disc are joined or separated one from another, for placing the stem of said valve in an unblocked or blocked position.

2. The safety knob for the domestic gas apparatus as claimed in claim 1, wherein the safety means includes a bolt, said bolt being insertable in a circumferential groove in a front part of the domestic gas apparatus for limiting the turning movement of the safety means between the blocked position and the unblocked position.

3. The safety knob for the domestic gas apparatus as claimed in claim 1, wherein the second coupling element is a cam for facilitating the sliding of the knob on the safety means.

* * * * *